US007111906B2

(12) United States Patent
Heisey et al.

(10) Patent No.: US 7,111,906 B2
(45) Date of Patent: Sep. 26, 2006

(54) FLEXIBLE SEAT MOUNT FOR CHAIR SEAT BOTTOM

(75) Inventors: Nathan W. Heisey, Columbus, IN (US); Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 127 days.

(21) Appl. No.: 10/443,367

(22) Filed: May 22, 2003

(65) Prior Publication Data

US 2004/0232755 A1 Nov. 25, 2004

(51) Int. Cl.
*A47C 7/00* (2006.01)

(52) U.S. Cl. ..... 297/440.22; 297/440.2; 297/463.1; 297/447.3; 297/448.2

(58) Field of Classification Search ..... 297/440.22, 297/440.2, 452.52, 452.55, 440.24, 451.13, 297/463.1, 447.3, 448.2; 248/200, 300, 230.1, 248/227.4

See application file for complete search history.

(56) References Cited

U.S. PATENT DOCUMENTS

| | | | | | |
|---|---|---|---|---|---|
| 1,355,669 | A | * | 10/1920 | Henry | 297/440.22 |
| 1,516,771 | A | | 11/1924 | Hedges | |
| 1,735,321 | A | | 11/1929 | Kilburn | |
| 3,125,156 | A | * | 3/1964 | Grimshaw | 160/382 |
| 3,147,495 | A | * | 9/1964 | Erik | 5/191 |
| 3,431,022 | A | | 3/1969 | Poppe et al. | |
| 3,601,348 | A | * | 8/1971 | Gonsalves et al. | 248/300 |
| 3,825,302 | A | | 7/1974 | Kurtz | |
| 3,913,978 | A | * | 10/1975 | Lester | 297/448.2 |
| 4,141,107 | A | * | 2/1979 | Sheiman et al. | 16/221 |
| 4,169,625 | A | | 10/1979 | Petersen | |
| 4,305,617 | A | * | 12/1981 | Benoit | 297/448.2 |
| 4,629,246 | A | | 12/1986 | Fulton | |
| 4,643,480 | A | * | 2/1987 | Morita | 297/452.38 |
| 5,064,247 | A | * | 11/1991 | Clark et al. | 297/447.3 |
| 5,110,186 | A | | 5/1992 | Clark et al. | |
| 5,123,702 | A | | 6/1992 | Caruso | |
| 5,538,325 | A | * | 7/1996 | Bullard | 297/440.22 |
| RE35,485 | E | * | 4/1997 | Stewart | 248/429 |
| 5,626,394 | A | * | 5/1997 | Perry | 297/448.2 |
| 5,720,093 | A | * | 2/1998 | Yoder, Jr. | 29/426.4 |
| 5,820,217 | A | * | 10/1998 | Horner et al. | 297/344.11 |
| 5,848,824 | A | * | 12/1998 | Mocur | 297/440.2 |
| 5,857,750 | A | * | 1/1999 | Kashiwamura et al. | 297/452.55 |
| 5,954,402 | A | * | 9/1999 | McInturff | 297/440.22 |
| 6,027,171 | A | * | 2/2000 | Partington et al. | 297/452.18 |
| 6,116,692 | A | * | 9/2000 | Tarnay et al. | 297/440.2 |
| 6,116,694 | A | * | 9/2000 | Bullard | 297/452.52 |
| 6,250,718 | B1 | * | 6/2001 | Newhouse et al. | 297/452.1 |
| 6,616,239 | B1 | * | 9/2003 | Guillot | 297/452.54 |
| 6,637,823 | B1 | * | 10/2003 | Ursini et al. | 297/440.2 |

* cited by examiner

*Primary Examiner*—Peter M. Cuomo
*Assistant Examiner*—Erika Garrett
(74) *Attorney, Agent, or Firm*—Barnes & Thornburg LLP

(57) ABSTRACT

A chair includes a frame and a seat bottom associated with the frame. Flexible seat mounts are used to retain the seat bottom on the frame.

33 Claims, 2 Drawing Sheets

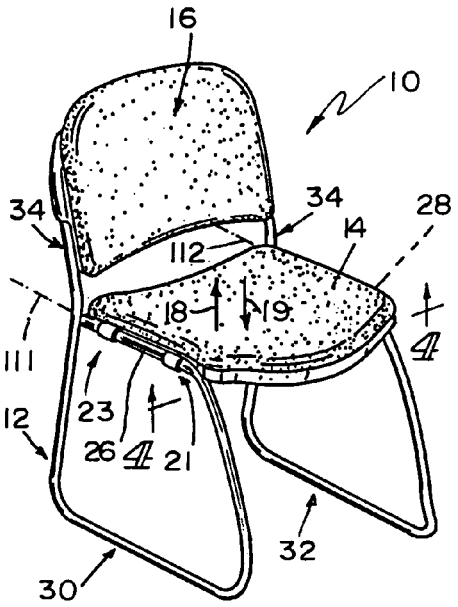
FIG. 1
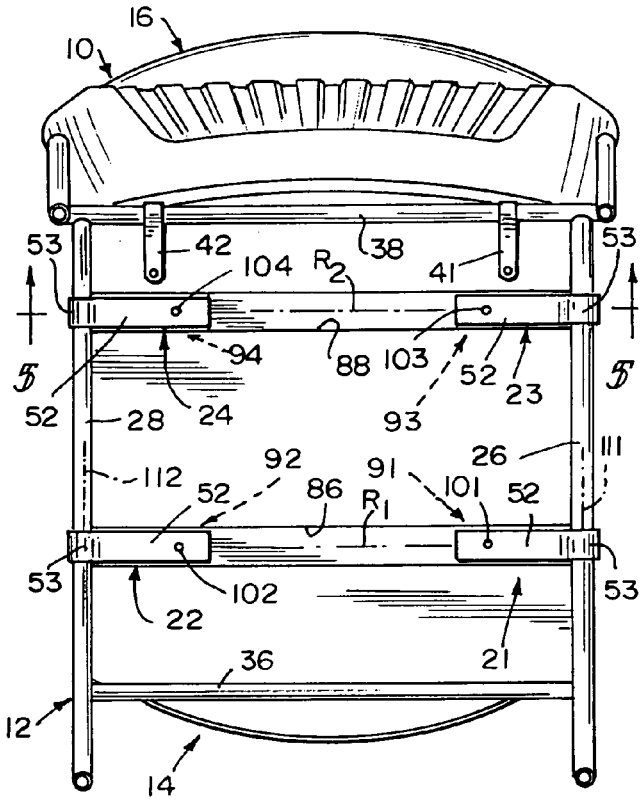
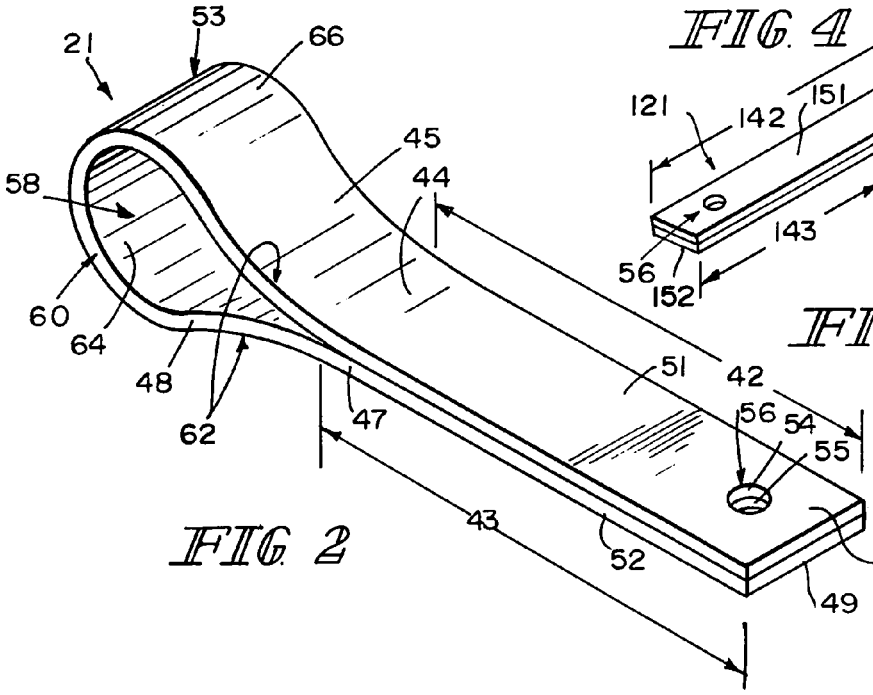
FIG. 2
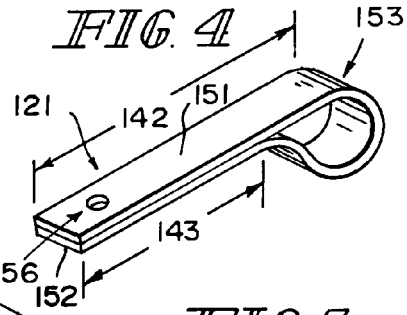
FIG. 3
FIG. 4

FLEXIBLE SEAT MOUNT FOR CHAIR SEAT BOTTOM

BACKGROUND AND SUMMARY

The present disclosure relates to chairs, and particularly to chairs including seat backs and bottoms mounted on a tubular frame. More particularly, the present disclosure relates to brackets for mounting seat bottoms on chair frames.

According to the present disclosure, a chair includes a frame, a seat bottom associated with the frame, and flexible seat mounts configured to retain the seat bottom in place on the frame while allowing some limited movement of the seat bottom relative to the frame without damaging the seat bottom retaining function of the flexible seat mounts. During use, static and dynamic loads are applied to the seat bottom and the flexible seat mounts are configured to allow some movement of the seat bottom relative to the frame and yet maintain the seat bottom in a position coupled securely to the frame.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a chair including a frame, a seat back mounted on the frame, and a seat bottom mounted on the frame using four flexible seat bottom mounts;

FIG. 2 is an enlarged perspective view of one of the seat bottom mounts shown in FIG. 1 showing a loop formed to define a tube-receiving channel and interconnect ends of side-by-side strips;

FIG. 3 is a view of another embodiment of a seat bottom mount in accordance with the present disclosure;

FIG. 4 is a view taken along line 4—4 of FIG. 1 showing four flexible seat bottom mounts coupled to the frame and to the underside of the seat bottom;

DETAILED DESCRIPTION

Figure 5:
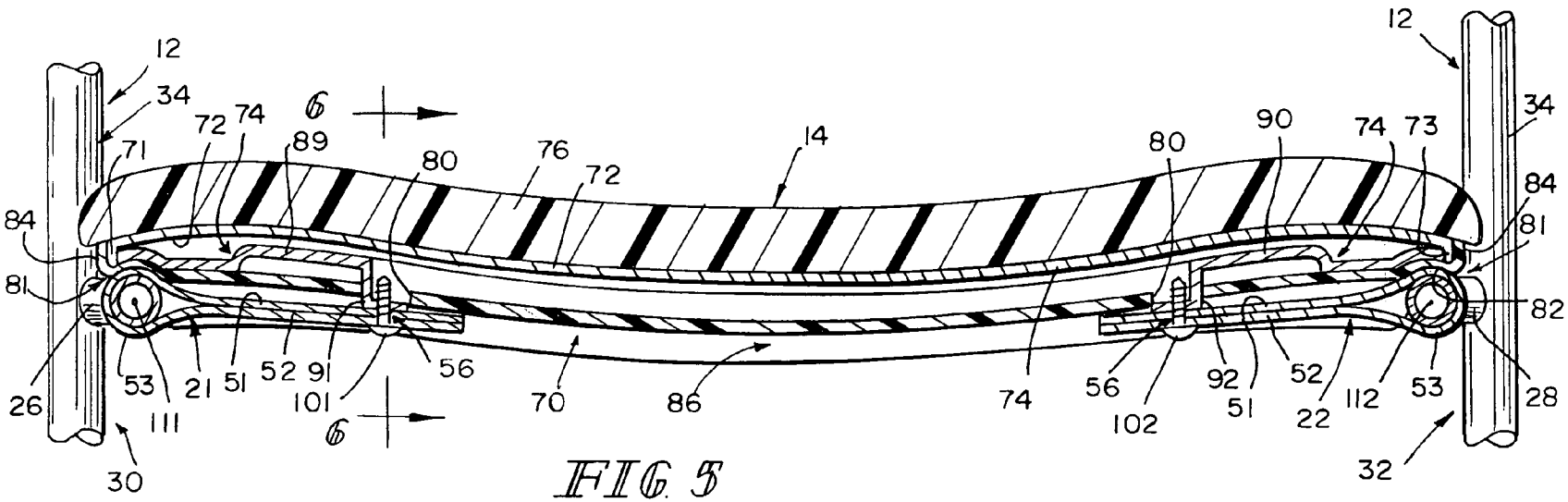
FIG. 5 is an enlarged sectional view taken along line 5—5 of FIG. 4 showing tubular portions of the frame passing through tube-receiving channels formed in two of the flexible seat bottom mounts and showing fasteners coupling strips included in the flexible seat bottom mounts to a support plate included in the seat bottom.
Figure 6:
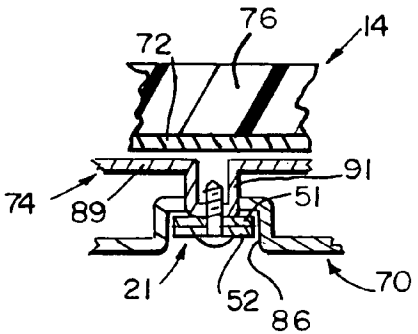
FIG. 6 is a sectional view taken along line 6—6 of FIG. 5 showing placement of the strips included in one of the flexible seat bottom mounts in a laterally extending mount channel formed in the seat bottom.

Chair 10 includes a frame 12, a seat bottom 14, and a seat back 16 as shown, for example, in FIGS. 1 and 2. Flexible seat mounts 21, 22, 23, and 24 are configured and located to yieldably retain seat bottom 14 in a "tethered" position on frame 12 to allow limited vertical movement of seat bottom 14 in direction 17 and 18 during loading and unloading of seat bottom 14 of the type that may occur when someone sits on or places objects on seat bottom 14. As such, seat bottom 14 is thus free to move on flexible seat mounts 21, 22, 23, and 24 somewhat relative to frame 12 during expected static and dynamic loading of seat bottom 14 without breaking or otherwise damaging flexible seat mounts 21, 22, 23, and 24 or separating seat bottom 14 from frame 12.

Frame 12 includes first and second horizontally extending side rails 26, 28 arranged to lie in spaced-apart parallel relation to one another and extend underneath seat bottom 14 as shown, for example, in FIGS. 4 and 5. Frame 12 also includes a first side rail support 30 coupled to first side rail 26 and a second side rail support 32 coupled to second side rail 28 as suggested in FIG. 1. Frame 12 further includes a back support 34 coupled to each of the first and second side rail supports 30, 32 and coupled to seat back 16 to retain seat back 16 in a fixed position above seat bottom 14 as suggested in FIG. 1. Front and rear laterally extending support tubes 36, 38 interconnect first and second side rail supports 30, 32 and extend under seat bottom 14 as shown, for example, in FIG. 4. Flexible straps 41, 42 couple a rear portion of seat bottom 14 to rear laterally extending support tube 38 to allow movement of seat bottom 14 relative to frame 12. In the illustrated embodiment, frame 12 is made of bent cylindrical metal tubes.

Four flexible seat mounts 21, 22, 23, and 24 are used to support seat bottom 14 on frame 12 in the illustrated embodiment. In this embodiment, each of the seat mounts has the same configuration as the other seat mounts. The configuration of a first of the seat mounts is shown, for example, in FIG. 2 and is described below.

First flexible seat mount 21 comprises first and second strips 51, 52 and a loop 53 arranged to interconnect first and second strips 51, 52 as shown, for example, in FIG. 2. In this embodiment, first strip 51 has a length 42 that is about equivalent to the length 43 of second strip 52. A proximal end 44 of first strip 51 is coupled to a first end 45 of loop 53 and a distal end 46 of first strip 51 is formed to include a first fastener receiver 54. A proximal end 47 of second strip 52 is coupled to a second end 48 of loop 53 and a distal end 49 of second strip 52 is formed to include a second fastener receiver 55 aligned with first fastener receiver 54 as suggested in FIG. 2 to form a fastener-receiving passageway 56 extending through. First flexible seat mount 21 is monolithic and made of an elastic material such as spring steel in the illustrated embodiment.

Loop 53 of first flexible seat mount 21 is shown, for example, in FIG. 2. Loop 53 is formed to include a channel 58 arranged to receive a portion of frame 12 (e.g., side rail 26) therein. Loop 53 includes a partial cylindrical portion 60 and a V-shaped converging portion 62 interconnecting partial cylindrical portion 60 and proximal ends 44, 47 of first and second strips 51, 52. V-shaped converging portion 62 comprises first and second ends 45, 48 of loop 53. Partial cylindrical portion 60 of loop 53 includes a curved or semicylindrical inner surface 64 and a curved exterior surface 66. Loop 53 has a teardrop-shape cross-section as suggested in FIG. 2.

As suggested in FIGS. 1 and 5, a portion of frame 12 defined by first horizontally extending side rail 26 is received in channel 58 defined by loop 53 to lie in rotative bearing engagement with inner surface 64 of partial cylindrical portion 60 of loop 53. This allows relative movement of first flexible seat mount 21 relative to side rail 26 during static and dynamic loading and unloading of seat bottom 14. At the same time, some deformation of the elements comprising first flexible seat mount 21 within the elastic limit of the material used to form seat mount 21 is expected. As a result, some movement of seat bottom 14 in direction 18, 19 relative to frame 12 is allowed without breaking or damaging first flexible seat mount 21 (and any of the other seat mounts 22, 23, 24) which might otherwise lead to separation of seat bottom 14 from frame 12.

In another illustrative embodiment, a flexible seat mount 121 includes a first strip 151, a second strip 152, and a loop 153 as suggested in FIG. 3. In this embodiment, the length 142 of first strip 151 is greater than the length 143 of second strip 152 and the shape of loop 153, while still teardrop-shaped, is asymmetric (in contrast to the symmetric shape of loop 53 as shown in FIG. 2).

As shown best in FIG. 5, seat bottom 14 includes a support plate 70, a top plate 72, and an anchor plate 74 located in a space between support plate 70 and top plate 72. A cushion 76 is mounted on an upwardly facing surface of top plate 72.

Support plate 70 includes a panel 78 formed to include one anchor aperture 80 associated with each of the four flexible seat mounts 21, 22, 23, and 24 (two of the anchor apertures 80 are shown in FIG. 5). Outer perimeter portions 81 of the panel 78 are formed to define curved interior surfaces 82 configured to mate with the curved exterior surface 66 of the flexible seat mount loops 53 as suggested in FIG. 5. Support plate 70 also includes an upstanding rim 84 appended to the outer edge of each outer perimeter portion 81. The underside of support plate 70 is formed to include two spaced-apart parallel channels 86, 88 sized to receive portions of the flexible seat mounts 21, 22, 23, and 24 therein s suggested in FIGS. 4 and 5.

Anchor plate 74 includes a first plate mount 89 located along the left side of seat bottom 14 and a second plate mount 90 located along the right side of seat bottom 14 as suggested in FIG. 5. First and third fastener anchors 91, 93 are appended to first plate mount 89 and second and fourth fastener anchors 92, 94 are appended to second plate mount 90. Each of fastener anchors 91, 92, 93, 94 is arranged to extend downwardly through one of the anchor apertures 80 formed in support plate 70 and is formed to include a fastener-receiving aperture therein. As shown, for example, in FIG. 5, first fastener anchor 91 mates with first strip 51 of second flexible seat mount 22. The fastener-receiving passageways 56 formed in the flexible seat mounts match up with the fastener-receiving apertures formed in the fastener anchors as suggested in FIG. 5.

Top plate 72 is arranged to overlie anchor plate 74 as shown, for example, in FIG. 5. Top plate 72 includes first and second flanges 71, 73. Each flange 71 and 73 is arranged to lie in a space between a perimeter edge of anchor plate 74 and a perimeter rim 84 included in support plate 70 as shown, for example, in FIG. 5.

Chair 10 further includes fasteners 101, 102, 103, and 104. As suggested in FIGS. 4 and 5, first fastener 101 is coupled to first fastener anchor 91 to couple first flexible seat mount 21 to anchor plate 74 and second fastener 102 is coupled to second fastener anchor 92 to couple second flexible seat mount 22 to anchor plate 74. Also, third fastener 103 is coupled to third fastener anchor 93 to couple third flexible seat mount 23 to anchor plate 74 and fourth fastener 104 is coupled to fourth fastener anchor 94 to couple fourth flexible seat mount 24 to anchor plate 74. As shown in FIG. 5, first fastener anchor 91 extends through first anchor aperture 80 and mates with first fastener 101 to anchor the distal end of first flexible seat mount 21 to seat bottom 14. Also, second fastener anchor 92 extends through second aperture anchor 80 and mates with second fastener 102 to anchor the distal end of second flexible seat mount 22 to seat bottom 14.

As shown, for example, in FIG. 4, the distal ends of first and second flexible seat mounts 21, 22 are positioned to lie in spaced-apart confronting relation to one another in channel 86. Also, the distal ends of third and fourth flexible seat mounts 23, 24 are positioned to lie in spaced-apart confronting relation to one another in channel 88.

As suggested in FIGS. 4 and 5, first flexible seat mount 21 is wrapped around a portion of first horizontally extending side rail 26 and third flexible seat mount 23 is wrapped around another portion of first horizontally extending side rail 26. First and third flexible seat mounts 21, 23 operate alone and together to define first retainer means anchored to a first side portion of seat bottom 14 for establishing rotative bearing engagement with an exterior surface of first horizontally extending side rail 26 o allow the first side portion to rotate about an axis of rotation 111 extending through and along first horizontally extending side rail 26.

Second flexible seat mount 22 is wrapped around a portion of second horizontally extending side rail 28 and fourth flexible seat mount 24 is wrapped around another portion of second horizontally extending side rail 28. Second and fourth flexible seat mounts 22, 24 operate alone and together to define second retainer means anchored to an opposite second side portion of seat bottom 14 for establishing rotative bearing engagement with an exterior surface of second horizontally extending side rail 28 to allow the second side portion to rotate about an axis of rotation 112 extending through and along second horizontally extending side rail 28.

Each flexible seat mount 21, 22, 23, and 24 comprises a sleeve portion configured to slidably receive a tubular frame portion therein and a strap portion arranged to extend under and be coupled to the seat bottom of a chair (using a fastener). These four flexible "brackets" are configured to support the seat bottom on the frame and allow limited up-and-down movement of the seat bottom relative to the frame without resort to use of any welds. A weld joint could be torqued when a seat bottom is deflected under load to induce fatigue into the weld joint. Such a situation does not apply to weld-free flexible seat mounts 21, 22, 23, and 24 as there is no bending moment on the side rail or its attachment point during such "seat-bottom loading" events. Although the illustrated frame 12 is shown to be a sled base, flexible seat mounts 21, 22, 23, and 24 are intended for use with a wide variety of chair frames.

Each of the first and second of the flexible seat mounts 21, 22 extend along a portion of a first reference line $R_1$ oriented to be in perpendicular relation to each of the first and second horizontally extending side rails 26, 28. The third and fourth of the flexible seat mounts 23, 24 extend along a portion of a second reference line $R_2$ oriented to lie in perpendicular relation to each of the first and second horizontally extending side rails 26, 28.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A chair comprising a frame, a seat bottom associated with the frame, mount means for yieldably retaining the seat bottom in a horizontally extending tethered position on the frame to allow limited vertical movement of the seat bottom relative to the frame during loading and unloading of the seat bottom so that the seat bottom is free to move relative to the frame, the mount means including at least one flexible seat mount including first and second strips arranged to lie in side-by-side relation to one another and a loop arranged to interconnect the first and second strips and formed to include a channel arranged to receive a portion of the frame therein and a fastener arranged to couple the first and second strips into the seat bottom; and wherein the seat bottom includes a downwardly facing curved concave surface mating with an upwardly facing curved surface included in the loop of the first of the flexible seat mounts.

2. The chair of claim 1, wherein the frame includes spaced-apart first and second horizontally extending side rails, the first horizontally extending side rail extends through the channel formed in the loop included in a first of the flexible seat mounts, and the second horizontally extending side rail extends through the channel formed in the loop included in a second of the flexible seat mounts.

3. The chair of claim 2, wherein each of the first and second of the flexible seat mounts includes a distal tip and the distal tips are arranged to lie in spaced-apart relation to one another.

4. The chair of claim 2, wherein each of the first and second of the flexible seat mounts extend along a portion of a first reference line oriented to lie in perpendicular relation to each of the first and second horizontally extending side rails.

5. The chair of claim 2, wherein the first horizontally extending side rail also extends through the channel formed in the loop included in a third of the flexible seat mounts and the second horizontally extending side rail also extends through the channel formed in the loop included in a fourth of the flexible seat mounts.

6. The chair of claim 5, wherein each of the first and second of the flexible seat mounts extend along a portion of a first reference line oriented to lie in perpendicular relation to each of the first and second horizontally extending side rails, each of the third and fourth of the flexible seat mounts extend along a portion of a second reference line oriented to lie in perpendicular relation to each of the first and second horizontally extending side rail, and the first and second reference lines are arranged to lie in spaced-apart parallel relation to one another.

7. The chair of claim 5, wherein the third and fourth of the flexible seat mounts extend along a portion of a second reference line oriented to lie in perpendicular relation to each of the first and second horizontally extending side rails.

8. The chair of claim 1, wherein one end of the first strip is coupled to one end of the loop and another end of the first strip is formed to include a first fastener receiver, one end of the second strip is coupled to another end of the loop and another end of the second strip is formed to include a second fastener receiver, and the fastener is arranged to extend through the first and second fastener receivers and mate with the first strip and the seat bottom to retain the first and second strips in an anchored position relative to the seat bottom.

9. The chair of claim 8, wherein a length of the first strip is about equivalent to a length of the second strip.

10. The chair of claim 8, wherein a length of the second strip is greater than a length of the first strip.

11. The chair of claim 8, wherein the loop has a teardrop-shape cross-section.

12. The chair of claim 8, wherein the loop includes a partial cylindrical portion and a V-shaped converging portion interconnecting the partial cylindrical portion and the first and second strips.

13. The chair of claim 12, wherein the portion of the frame received in the channel is positioned to lie in rotative bearing engagement with an inner surface of the partial cylindrical portion of the loop to allow relative movement of a first of the flexible seat mounts relative to the portion of the frame received in the channel during loading and unloading of the seat bottom.

14. The chair of claim 1, wherein the loop has a teardrop-shape cross-section.

15. The chair of claim 1, wherein the loop includes a partial cylindrical portion and a V-shaped converging portion interconnecting the partial cylindrical portion and the first and second strips.

16. The chair of claim 1, wherein the portion of the frame received in the channel is positioned to lie in rotative bearing engagement with an inner surface of the loop to allow movement of a first of the flexible seat mounts relative to the portion of the frame received in the channel during loading and unloading of the seat bottom.

17. The chair of claim 16, wherein the inner surface of the loop has a semicylindrical shape and the portion of the frame has a cylindrical shape.

18. A chair comprising a frame including first and second horizontally extending side rails, a seat bottom associated with the frame, first and second fasteners, a first flexible seat mount wrapped around a portion of the first horizontally extending side rail and configured to include a distal end anchored to the seat bottom by the first fastener, a second flexible seat mount wrapped around a portion of the second horizontally extending side rail and configured to include a distal end anchored to the seat bottom by the second fastener; and wherein the seat bottom is formed to include a support plate and a channel extending across a width of the seat bottom and the distal ends of the first and second flexible seat mounts lie in the channel below the support plate.

19. The chair of claim 18, wherein the distal ends of each of the first and second flexible seat mounts are positioned to lie in spaced-apart relation to one another.

20. The chair of claim 19, wherein each distal end is formed to include a fastener receiver, the first fastener extends through the fastener receiver formed in the first flexible seat mount, and the second fastener extends through the fastener receiver formed in the second flexible seat mount.

21. The chair of claim 20, further comprising third and fourth fasteners, a third flexible seat mount wrapped around another portion of the first horizontally extending side rail and configured to include a distal end anchored to the seat bottom by the third fastener, and a fourth flexible seat mount wrapped around another portion of the second horizontally extending side rail and configured to include a distal end anchored to the seat bottom by the fourth fastener.

22. The chair of claim 21, wherein the distal ends of the first and second flexible seat mounts are positioned to lie in spaced-apart confronting relation to one another and the distal ends of the third and fourth flexible seat mounts are positioned to lie in spaced-apart confronting relation to one another.

23. The chair of claim 22, wherein each distal end is formed to include a fastener receiver, the first fastener extends through the fastener receiver formed in the first flexible seat mount, and the second fastener extends through the fastener receiver formed in the second flexible seat mount, the third fastener extends through the fastener receiver formed in the third flexible seat mount, and the fourth fastener extends through the fastener receiver formed in the front flexible seat mount.

24. The chair of claim 18, wherein the seat bottom includes an anchor plate including a plate mount, a first fastener anchor configured to mate with the first fastener, and a second fastener anchor configured to mate with the second fastener, the seat bottom further includes a support plate arranged to lie between the anchor plate and the first and second flexible seat mounts and to mate with the first and second flexible mounts, the support plate is formed to include first and second anchor apertures, the first fastener anchor extends through the first anchor aperture and mates with the first fastener to anchor the distal end of the first flexible seat mount to the seat bottom, and the second fastener anchor extends through the second fastener aperture and mates with the second fastener to anchor the distal end of the second flexible seat mount to the seat bottom.

25. The chair of claim 24, wherein the first flexible seat mount includes a first strip coupled to the first fastener anchor by the first fastener and a loop coupled to the first strip and formed to include a channel arranged to receive a portion of the frame therein, the loop includes an exterior surface, the support plate includes an interior surface mating with the exterior surface of the loop and an exterior surface, and the anchor plate includes an interior surface mating with the exterior surface of the support plate.

26. The chair of claim 25, wherein the first flexible seat mount further includes a second strip coupled to the loop and arranged to lie alongside the first strip and the second strip is coupled to the first fastener anchor by the first fastener.

27. The chair of claim 25, wherein the exterior surfaces of each of the loop and the support plate are curved and the interior surfaces of each of the support plate and anchor plate are curved.

28. The chair of claim 25, wherein the seat bottom further includes a top plate arranged to overlie the anchor plate and formed to include a flange arranged to lie in a space between a perimeter edge of the anchor plate and a perimeter rim included in the support plate, and a portion of the top plate is arranged to lie in confronting relation to the exterior surface of the anchor plate.

29. The chair of claim 25, wherein the seat bottom further includes a top plate arranged to overlie the anchor plate and formed to include a flange arranged to lie in a space between a perimeter edge of the anchor plate and a perimeter rim included in the support plate, and a portion of the top plate is arranged to lie in confronting relation to the exterior surface of the anchor plate.

30. A chair comprising a frame including first and second horizontally extending side rails, a seat bottom associated with the frame, first and second fasteners, a first flexible seat mount wrapped around a portion of the first horizontally extending side rail and configured to include a distal end anchored to the seat bottom by the first fastener, a second flexible seat mount wrapped around a portion of the second horizontally extending side rail and configured to include a distal end anchored to the seat bottom by the second fastener, and wherein the seat bottom includes an anchor plate including a plate mount, a first fastener anchor configured to mate with the first fastener, and a second fastener anchor configured to mate with the second fastener, the seat bottom further includes a support plate arranged to lie between the anchor plate and the first and second flexible seat mounts and to mate with the first and second flexible mounts, the support plate is formed to include first and second anchor apertures, the first fastener anchor extends through the first anchor aperture and mates with the first fastener to anchor the distal end of the first flexible seat mount to the seat bottom, and the second fastener anchor extends through the second fastener aperture and mates with the second fastener to anchor the distal end of the second flexible seat mount to the seat bottom.

31. The chair of claim 30, wherein the first flexible seat mount includes a first strip coupled to the first fastener anchor by the first fastener and a loop coupled to the first strip and formed to include a channel arranged to receive a portion of the frame therein, the loop includes an exterior surface, the support plate includes an interior surface mating with the exterior surface of the loop and an exterior surface, and the anchor plate includes an interior surface mating with the exterior surface of the support plate.

32. The chair of claim 31, wherein the first flexible seat mount further includes a second strip coupled to the loop and arranged to lie alongside the first strip and the second strip is coupled to the first fastener anchor by the first fastener.

33. The chair of claim 31, wherein the exterior surfaces of each of the loop and the support plate are curved and the interior surfaces of each of the support plate and anchor plate are curved.

* * * * *